US006546764B2

(12) United States Patent
Segawa

(10) Patent No.: US 6,546,764 B2
(45) Date of Patent: Apr. 15, 2003

(54) DOOR LOCKING HANDLE ASSEMBLY OF DOUBLE LOCK TYPE

(75) Inventor: Shirou Segawa, Tokyo (JP)

(73) Assignee: Takigen Manufacturing Co. Ltd., Tokyo (JP)

( * ) Notice: Subject to any disclaimer, the term of this patent is extended or adjusted under 35 U.S.C. 154(b) by 0 days.

(21) Appl. No.: 10/122,494

(22) Filed: Apr. 15, 2002

(65) Prior Publication Data

US 2002/0184930 A1 Dec. 12, 2002

(30) Foreign Application Priority Data

Jun. 7, 2001 (JP) ..... 2001-172977

(51) Int. Cl.[7] ..... E05B 13/10

(52) U.S. Cl. ..... 70/208; 70/210; 70/213; 70/215

(58) Field of Search ..... 70/208, 210, 213, 70/215–217

(56) References Cited

U.S. PATENT DOCUMENTS 2,156,513 A * 5/1939 Roedding ..... 292/332
2,377,301 A * 5/1945 Rolph ..... 70/208 X
3,745,796 A * 7/1973 Fleming ..... 70/208 X
5,440,905 A * 8/1995 Yamada ..... 70/208
5,452,596 A * 9/1995 Yamada ..... 70/208
5,454,239 A * 10/1995 Esaki et al. ..... 70/208
5,457,971 A * 10/1995 Yamada ..... 70/208
5,467,623 A * 11/1995 Yamada et al. ..... 70/208
5,490,404 A * 2/1996 Yamada ..... 70/210
6,053,018 A * 4/2000 Ramsauer ..... 70/208
6,182,483 B1 * 2/2001 von Kathen et al. ..... 70/208
6,263,712 B1 * 7/2001 Ramsauer ..... 70/208
6,427,501 B2 * 8/2002 Ramsauer ..... 70/208

* cited by examiner

*Primary Examiner*—Suzanne Dino Barrett
(74) *Attorney, Agent, or Firm*—Martin Smolowitz

(57) ABSTRACT

A door locking handle assembly with two locks makes its locking function and appearance stricter. Keys of these locks may lock and unlock a door handle (15). The assembly may permit only one of the keys to unlock the handle (15), if necessary. The handle (15) is mounted on a door (B) and capable of extending from and entering a handle holder (10) mounted on the door (B). A first lock (30) and a second lock (40) are mounted on a free end of the handle (15) and the holder (10), respectively, and adjacent to each other, and are provided with a first movable locking element (32) and a second movable locking element (42), respectively. When these locking elements (32, 42) are engaged with each other, the handle (15) is locked. When they (32, 42) are disengaged, the handle (15) is unlocked.

9 Claims, 7 Drawing Sheets

DOOR LOCKING HANDLE ASSEMBLY OF DOUBLE LOCK TYPE

BACKGROUND OF THE INVENTION

1. Field of the Invention

The present invention relates to a door locking handle assembly of a double lock type, wherein a door handle is capable of being pulled out of a handle holder and side-swung thereafter to make it possible to move a door between its locked and unlocked conditions.

2. Description of the Related Art

Heretofore, it has been known to provide a door locking handle assembly of the single lock type shown in U.S. Pat. No. 5,467,623, herein incorporated by reference. Such a door locking handle assembly is essentially mounted on a door of a plugboard box or the like such as an instrument box containing therein various types of instruments. However, the door locking assembly is also widely used in any other place such as a bunkhouse in the site of construction, a warehouse and the like. Recent deterioration in public peace makes door's lock management more important.

Heretofore, in such a door locking handle assembly, a lock employed in the assembly is typified by cylinder locks and dial locks, and mounted on either a portion of the handle holder or a free end portion of the door handle. In general, a door keeping person (hereinafter referred to as the "door keeper") holds and maintains a key of such a lock.

SUMMARY OF THE INVENTION

It is an object of the present invention to provide a door locking handle assembly of a double lock type, wherein: a first and a second lock are provided in the door locking handle assembly to provide a strict locking mechanism improved in function and also in appearance; and, a first and a second door keeper may hold and maintain a first and a second key, respectively, so as to independently control the door handle of the assembly.

It is also possible to control the door locking handle assembly of the present invention using a desired one of the first and the second keys, if necessary, wherein such a desired key is held and maintained by a senior one of the door keepers in order to strictly control the assembly through the management of the keys.

It is another object of the present invention to provide such a door locking handle assembly, wherein: the locks is capable of being independently controlled (i.e., locked and unlocked) using any one of the keys for convenience in maintenance performed by the door keepers; and, it is also possible for the door keepers to control the locks using a desired one of the keys, if necessary.

In accordance with a first aspect of the present invention, the above object of the present invention is accomplished by providing:

In a door locking handle assembly of a double lock type having a construction in which: a handle holder (10) is mounted on a front surface (B1) of a door (B) by means of a screw (11), the screw (11) passing through the door (B) from its rear surface (B2) to fix the handle holder (10) to the front surface (B1) of the door (B); a handle shaft (12) extending in a direction perpendicular to the plane of the door (B) is mounted on a proximal end portion of the handle holder (10); a door handle (15) has its proximal end portion mounted on a front end portion (13) of the handle shaft (12) through a pivot (14) extending in a direction perpendicular to a longitudinal axis of the handle shaft (12), the door handle (15) having its distal end portion swung between a folded position and a raised position in a reciprocating manner; and, a catch plate for locking the door (B) to a stationary frame element is fixedly mounted on a rear end portion (16) of the handle shaft (12), the rear end portion (16) appearing in the rear surface (B2) of the door (B), the improvement wherein:

a first lock (30) and a second lock (40) have their rear end portions fixedly mounted on an inner surface of a free end portion (17) of the door handle (15) and an inner surface of the handle holder (10), respectively, in a manner such that the locks (30, 40) are adjacent to each other in arrangement; and the first lock (30) and the second lock (40) are provided with a first key (K1) and a second (K2), respectively, to permit a user to lock and unlock the door handle (15) using at least one of the keys (K1, K2).

Further, in accordance with a second aspect of the present invention, the above object of the present invention is accomplished by providing:

The door locking handle assembly of the double lock type as set forth in the first aspect of the present invention, wherein:

each of the first lock (30) and the second lock (40) is constructed of a cylinder lock;

the first key (K1) is inserted into the first lock (30) of the handle holder (10), and turned to rotate a first rotor (31) of the first lock (30), so that a first movable locking element (32) is moved to its locked position adjacent to the free end portion of the door handle (15), wherein the first movable locking element (32) is constructed of one of a latch plate and a cam plate; and the second key (K2) is inserted into the second lock (40) of the door handle (15), and turned to rotate a second rotor (41) of the second lock (40), so that a second movable locking element (42) is moved between: its locked position in which the second movable locking element (42) is engaged with the first movable locking element (32); and, its unlocked position in which the second movable locking element (42) is disengaged from the first movable locking element (32), wherein both the locked position and the unlocked position of the second movable locking element (42) are adjacent to the first movable locking element (32).

In accordance with a third aspect of the present invention, the above object of the present invention is accomplished by providing:

The door locking handle assembly of the double lock type as set forth in the first aspect or the second aspect of the present invention, wherein:

the first rotor (31) of the first lock (30) disposed in the handle holder (10) is locked in each of its two locked positions and unlocked in its unlocked position, wherein the two locked positions are angularly spaced apart from each other by a predetermined angle, each of the two locked positions being also angularly spaced apart from the unlocked position by a predetermined angle;

the first movable locking element (32) is locked in each of its two locked positions and unlocked in its unlocked position, wherein the two locked positions are angularly spaced apart from each other by a predetermined angle and adjacent to the free end portion (17) of the door handle (15), each of the two locked positions being also angularly spaced apart from the unlocked position by a predetermined angle, wherein a first one of the two locked positions is closer to the free end portion (17) of the door handle (15) than the other to disable the second movable locking element (42) from disengaging from the first movable locking element (32) even when the second movable locking element (42) is moved to the unlocked position thereof;

the first movable locking element (32) is moved to the other of the two locked positions thereof to enable the second movable locking element (42) to engage with and disengage from the first movable locking element (32); and in the unlocked position of the first movable locking element (32), the second movable locking element (42) is always disengaged from the first movable locking element (32) irrespective of whether the second movable locking element (42) is in its locked position.

Here, each of the locks may be of any one of types including a cylinder lock, a pin tumbler type, a disc tumbler type, a dial type and the like. In the door locking handle assembly of the present invention, it is essential to insert the keys (K1, K2) in the locks to rotate their rotors, so that the first movable locking element (32) is engaged with or disengaged from the second movable locking element (42), wherein these movable locking elements are constructed of the latch plate or the cam plates.

Further, in the door locking handle assembly of the present invention, each of the movable locking elements (32, 42) may be constructed of a latch plate which performs a reciprocating linear motion when driven by the rotors (32, 41), or may be constructed of a cam plate which performs a rotating motion when driven by the rotors (32, 41).

The door locking handle assembly according to the first and the second aspect of the present invention enjoys the following effects:

Namely, though the first and second locks (30, 40) are independently provided in the handle holder (10) and the door handle (15), it is possible for the door keepers to lock and unlock the door handle (15) using any one of these locks (30, 40), which enables any one of the door keepers independently to lock and unlock the door handle (15).

Further, in the door locking handle assembly according to the second aspect of the present invention, since the second movable locking element (42) of the second lock 40 is so arranged as to be engaged with the first movable locking element (32) of the first lock 30 in locking operation of the door handle (15), it is possible to unlock the door handle (15) by moving any one of the first movable locking element (32) and the second movable locking element (42) to its unlocked position in which these movable locking elements (32, 42) are disengaged from each other.

In the door locking handle assembly according to the third aspect of the present invention, it is possible to enable only one or both of the keys (K1, K2) to unlock the door handle (15), which makes it possible to use one of the keys (K1, K2) as a primary control key.

Since the door locking handle assembly of the present invention is provided with two locks (30, 40), it is possible to make the door locking handle assembly of the present invention stricter in locking mechanism and also in appearance, which may prevent illegal access to the door locking handle assembly of the present invention.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

The best modes for carrying out the present invention will be described in detail using a first and a second embodiment of the present invention with reference to the accompanying drawings.

First Embodiment

A first embodiment of a door locking handle assembly according to the first and the second aspect of the present invention is shown in FIGS. 1 to 5.

Figure 1:
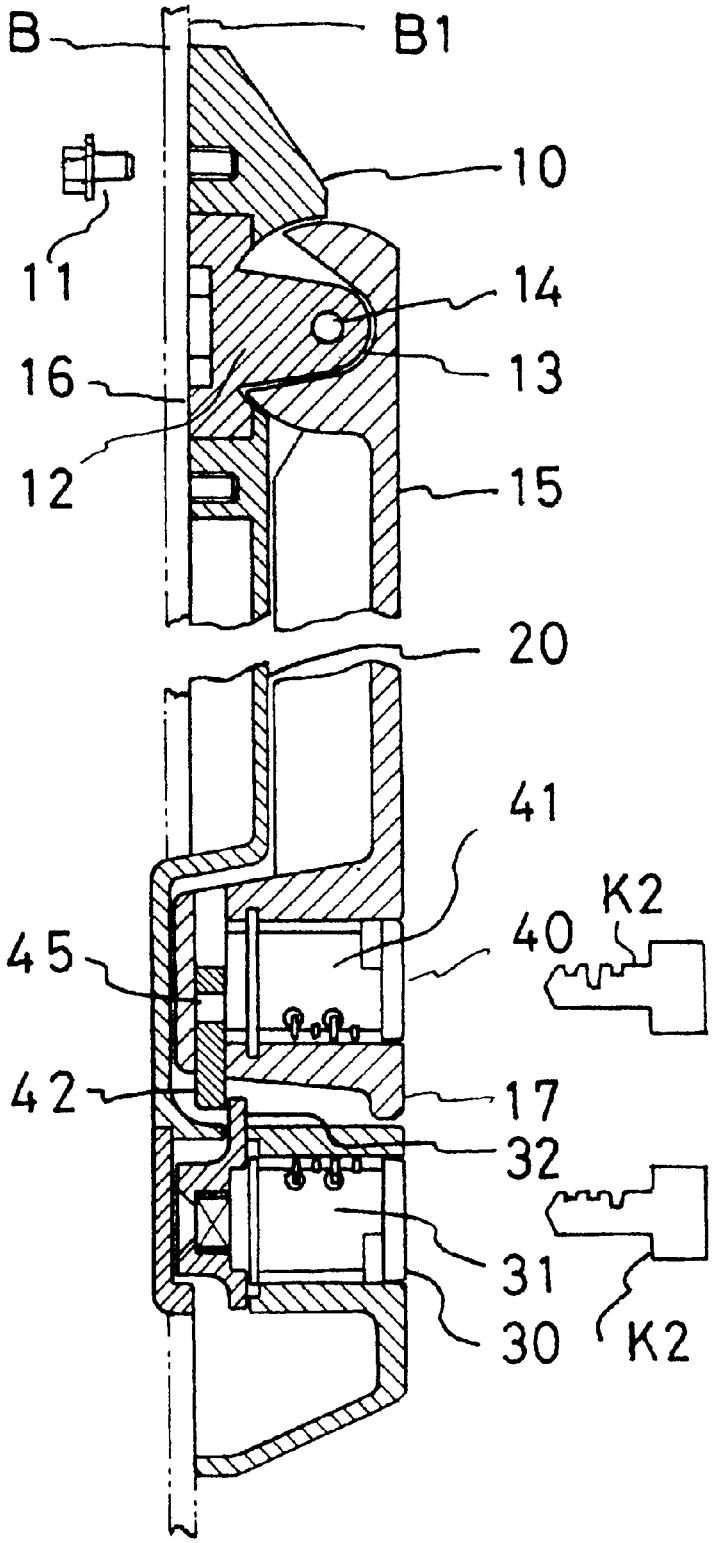
FIG. 1 is a longitudinal sectional view of a first embodiment of the door locking handle assembly of the present invention in its locked condition.

In the drawings, the reference numeral 10 denotes a handle holder provided with a concave portion 20 in its front surface, as shown in FIG. 1. The handle holder 10 is mounted on a front surface B1 of a door B by means of a screw 11 which passes through the door B from its rear surface B2 to fix the handle holder 10 to the front surface B1 of the door B. The concave portion 20 of the handle holder 10 receives a door handle 15 therein. On the other hand, a handle shaft 12 is mounted on an upper front portion 13 of the handle holder 10 in a manner such that the handle shaft 12 is rotatable on its longitudinal axis extending in a direction perpendicular to the plane of a door B, but not axially slidable in its longitudinal direction relative to the handle holder 10. A pivot 14 extends in a direction perpendicular to the longitudinal axis of the handle shaft 12 to pass through a front end portion of the handle shaft 12, and rotatably supports a proximal end portion of a door handle 15 to permit a distal end portion of the door handle 15 to swingably move between: its folded position embedded in the door handle holder 10; and, its raised position spaced apart forward from a front surface of the handle holder 10.

Fixedly mounted on a rear end portion 16 of the handle shaft 12 is a catch plate (not shown), which is substantially similar in construction to a "catch plate 11" described in U.S. Pat. No. 5,467,623, herein incorporated by reference. When such a catch plate is turned to extend from the rear side of the door B toward a stationary frame element (not shown) of a box containing various instruments and engage with the stationary frame element, the door B is locked to the stationary frame element. For example, the handle shaft 12 has its rear end portion 16 formed into a noncircular shape in cross section such as one of a square shape, a hexagonal shape, a semi-circular shape and like irregular shapes in cross section, which makes it possible for the above-mentioned catch plate (not shown) to be non-rotatably fixed to the rear end portion 16 of the handle shaft 12 in an insertion manner. After completion of insertion, the catch plate is firmly fixed to the rear end portion 16 of the handle shaft 12 using a screw to prevent the catch plate from axially slipping out of the rear end portion 16 of the handle shaft 12.

Figure 2:
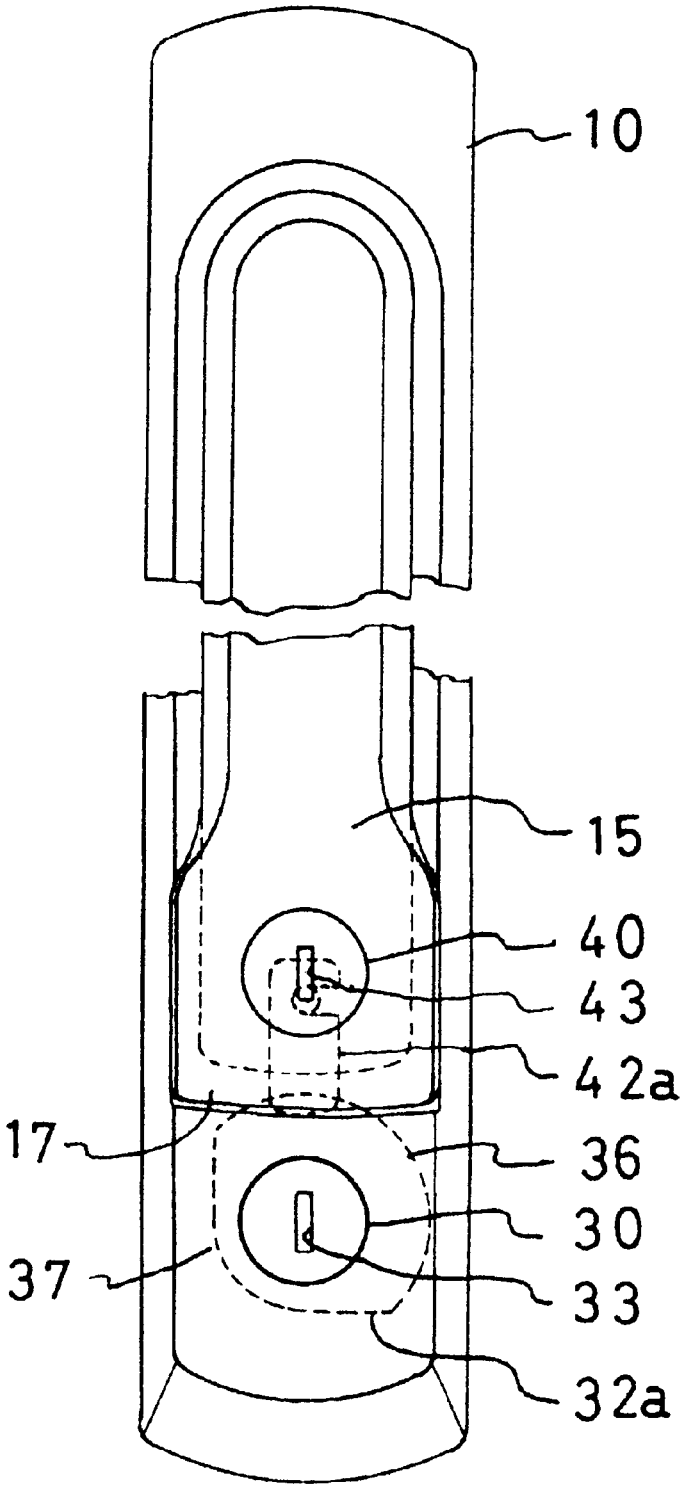
FIG. 2 is a front view of the door locking handle assembly shown in FIG. 1.

A first lock 30 is fixedly mounted on a front surface of the handle holder 10 so as to be adjacent to a free end portion 17 of the door handle 15, and has its first keyhole 33 exposed forward as viewed in FIG. 2. In operation, as shown in FIG. 2, when a first key K1 (shown in FIG. 1) is inserted into the keyhole 33 and turns a first rotor 31 of the first lock 30 through a predetermined angle such as 90 degrees, a large-diameter portion 36 of a cam plate 32*a* (shown in phantom line in FIG. 2) serving as a first movable locking element 32 mechanically interlocked with the first rotor 31 is also turned to move toward and away from the free end portion 17 of the door handle 15. Such a large-diameter portion 36 of the cam plate 32*a* corresponds to a locked position of the first lock 30. As is clear from FIG. 2, the cam plate 32*a* (shown in phantom line) is also provided with a small-diameter portion 37 corresponding an unlocked position of the first lock 30.

On the other hand, a second lock 40, which is substantially similar in construction to the first lock 30 except its latch plate 42*a*, is fixedly mounted on a front surface of the free end portion 17 of the door handle 15 so as to be adjacent to the first lock 30. In operation, as shown in FIG. 2, when a second key K2 (shown in FIG. 1) is inserted into a second keyhole 43 of the second lock 40 and turns a second rotor 41 (shown in FIG. 1) of the second lock 40, the latch plate 42*a* (shown in phantom line in FIG. 2) serving as a second movable locking element 42 mechanically interlocked with the second rotor 41 is also turned to have its lower end portion move toward and away from the cam plate 32*a* of the first lock 30. As is clear from FIG. 1, when the second rotor 41 is turned to have its latch plate 42*a* move downward and engaged with a rear surface of the cam plate 32*a* (shown in FIG. 1) of the first lock 30 in an overlapping manner, the door handle 15 is locked to the handle holder 10. In contrast with this, as shown in FIG. 3, when the second rotor 41 is turned to have its latch plate 42*a* move upward and therefore released from the rear surface of the cam plate 32*a* of the first lock 30, the door handle 15 is unlocked or released from the handle holder 10.

Figure 3:
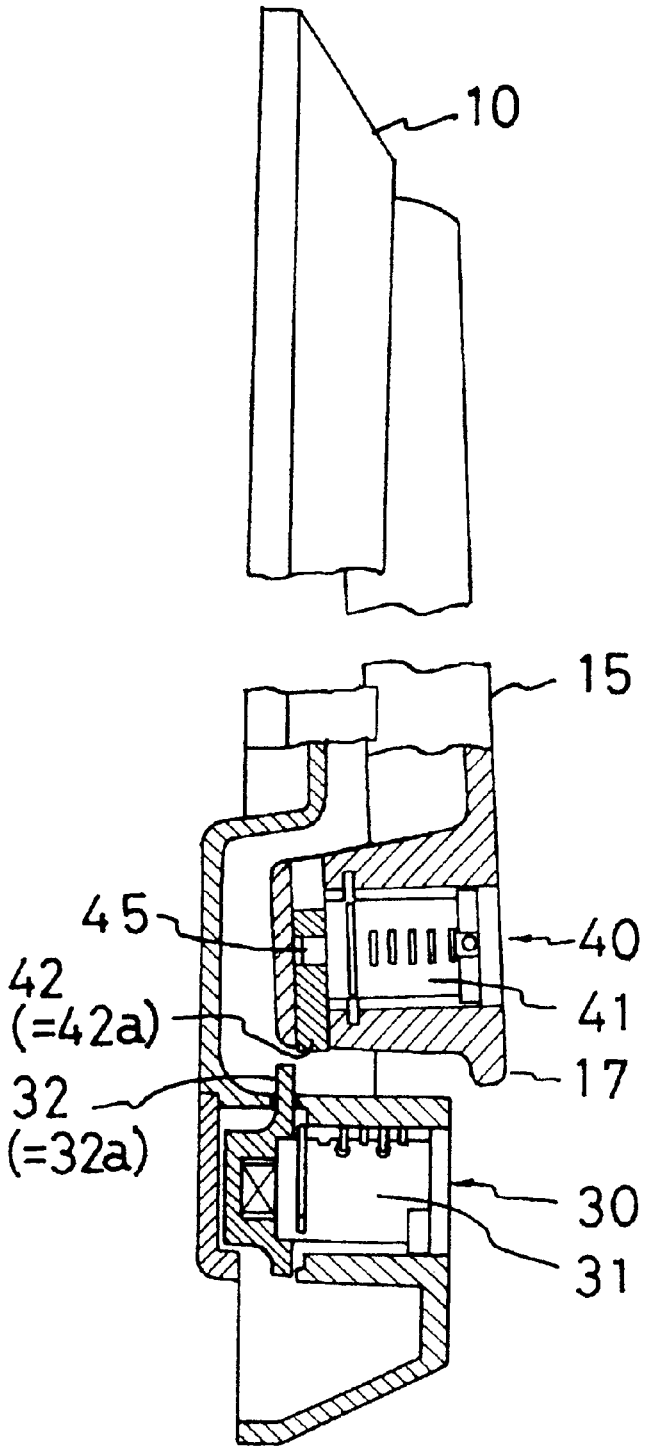
FIG. 3 is a partially broken side view of the door locking handle assembly of the present invention, illustrating the second lock having been disengaged from the first lock.

In this first embodiment, as is clear from FIGS. 1 and 3, the second rotor 41 is provided with an eccentric pin 45 which extends rearward from a rear surface of the second rotor 41 to slidably pass through the latch plate 42*a*. More specifically, the eccentric pin 45 is slidably received in a hole of the latch plate 42*a*, which makes it possible to linearly drive the latch plate 42*a* up and down in a reciprocating manner when the second rotor 41 is turned on its longitudinal axis by means of the second key K2. Due to this, the latch plate 42*a* is capable of being moved toward and away from the cam plate 32*a* of the first lock 30 in an area behind the rear surface of the cam plate 32*a*.

In operation, the door locking handle assembly of the first embodiment according to the first and the second aspect of the present invention will be now described.

First, with reference to FIGS. 1 and 2, a process for locking the door handle 15 to the handle holder 10 will be described.

The first key K1 is inserted into the first keyhole 33 of the first lock 30 to turn the first rotor 31 together with the cam plate 32*a* (i.e., the first movable locking element 32) in a manner such that the large-diameter portion 36 of the cam plate 32*a* is moved toward the free end portion 17 of the door handle 15. After the large-diameter portion 36 of the cam plate 32*a* reaches its highest position as viewed in FIG. 2, the first key K1 is removed from the first keyhole 33.

Next, the second key K2 is inserted into the second keyhole 43 of the second lock 40 to turn the second rotor 41 in a manner such that the latch plate 42*a* (i.e., the second movable locking element 42) is moved downward toward the cam plate 32*a* of the first lock 30 to place the latch plate 42*a* behind a rear surface of the cam plate 32*a* in an overlapping manner, as viewed in FIG. 1. After the latch plate 42*a* is placed behind the rear surface of the cam plate 32*a* in such an overlapping manner, the second key K2 is removed from the second keyhole 43 so that the door handle 15 is locked to the handle holder 10, as is clear from FIGS. 1 and 2. As a result, the door B is locked to the stationary frame element of the box, as described in the above with reference to the prior art (i.e., U.S. Pat. No. 5,467,623).

Figure 5:
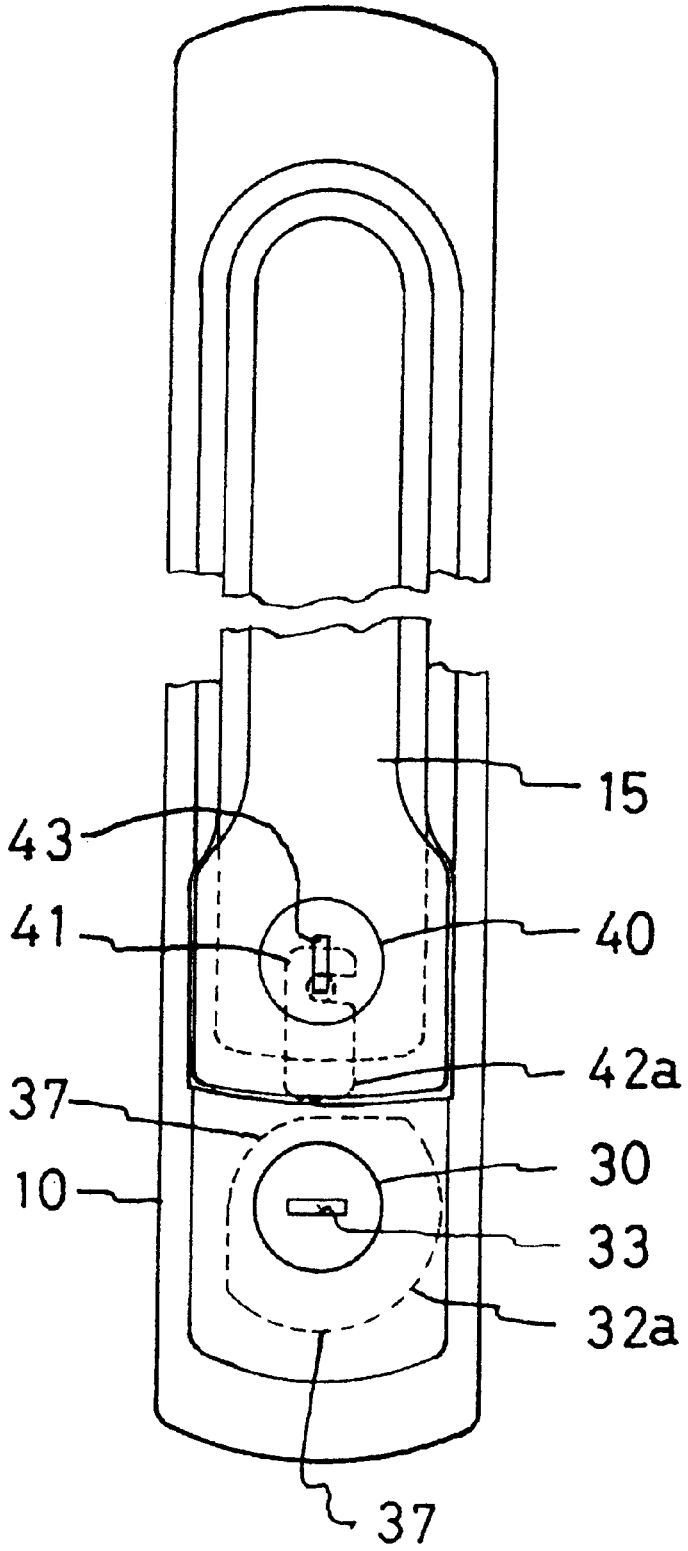
FIG. 5 is a front view of the door locking handle assembly in a condition in which the first lock is in its unlocked position.

When the door handle 15 is released from the handle holder 10, the first key K1 is inserted into the corresponding first keyhole 33 and tuned so that the first rotor 31 and the cam plate 32*a* are turned to have the large-diameter portion 36 of the cam plate 32*a* turned through an angle of 90 degrees, whereby the small-diameter portion 37 of the cam plate 32*a* is oppositely disposed from the latch plate 42*a* of the second lock 40, which permits the cam plate 32*a* to be released from contact with the latch plate 42*a*. As a result, the door handle 15 is completely released from the handle holder 10, as shown in FIG. 5.

Figure 4:
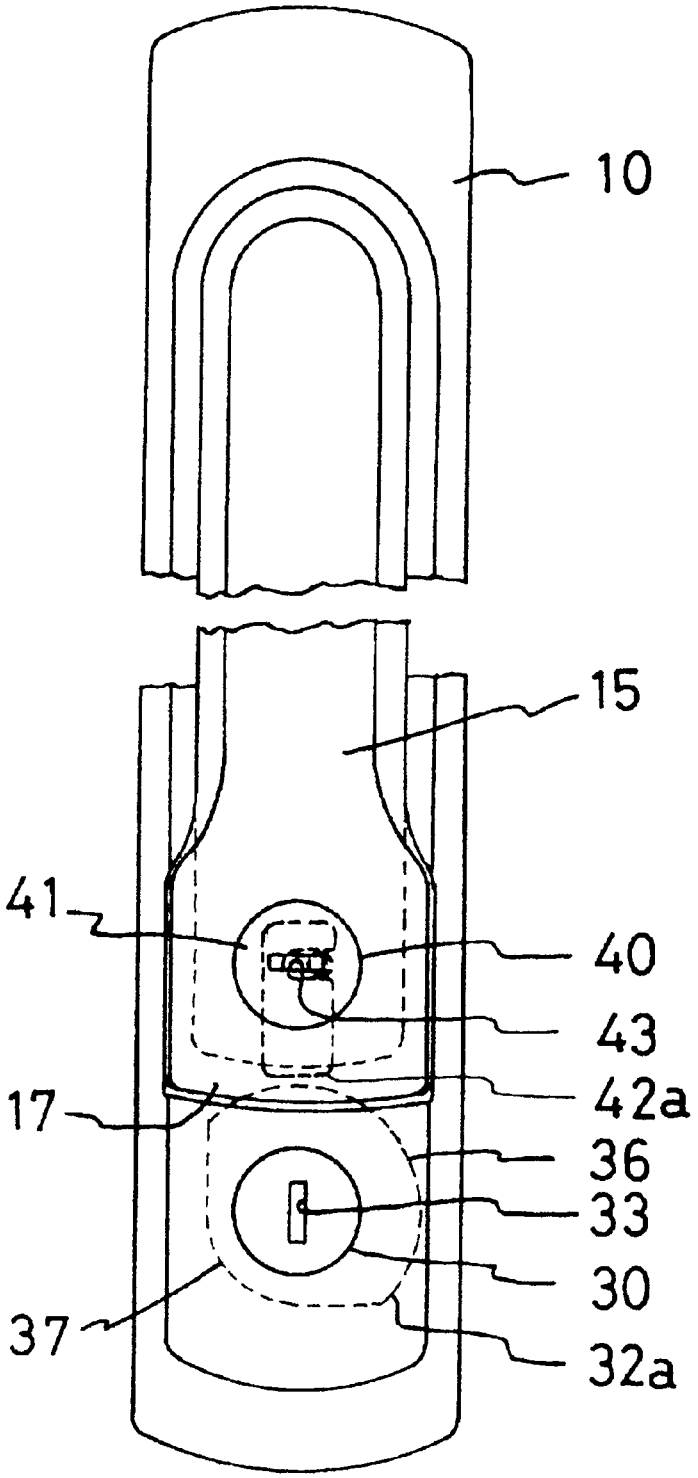
FIG. 4 is a front view of the door locking handle assembly in a condition in which the second lock is disengaged from the first lock as shown in FIG. 3.

As is clear from FIGS. 3 and 4, it is also possible to release the door handle 15 from the handle holder 10 by inserting the second key K2 into the second keyhole 43 of the second lock 40 to turn the second rotor 41. In this process, when the second rotor 41 is turned, the latch plate 42*a* is moved upward and retracted from the large-diameter portion 36 of the cam plate 32*a* so that the former is disengaged from the latter, which permits the door handle 15 to be released from the handle holder 10 and to have its free end portion 17 swingably moved forward to its raised position, as viewed in FIG. 3.

Consequently, it is possible for the door locking handle assembly of the present invention to have its keys K1, K2 maintained independently by the individual door keepers, which permits each of the door keepers to lock and unlock the door handle 15 at each door keeper's discretion.

Second Embodiment

Figure 6:
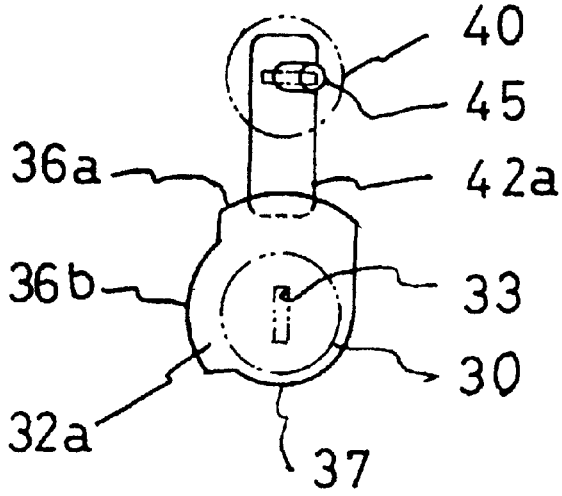
FIG. 6 is an enlarged front view of the movable locking elements of a second embodiment of the door locking handle assembly of the present invention, illustrating the first lock being in its locked condition in which the second lock can't unlock the door handle at all.
Figure 7:
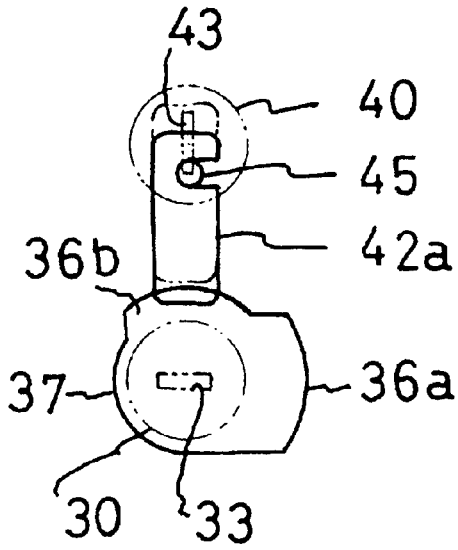
FIG. 7 is an enlarged front view of the movable locking elements of the second embodiment of the door locking handle assembly, illustrating the movable locking elements in a condition in which the door handle is capable of being unlocked using any one of the keys.
Figure 8:
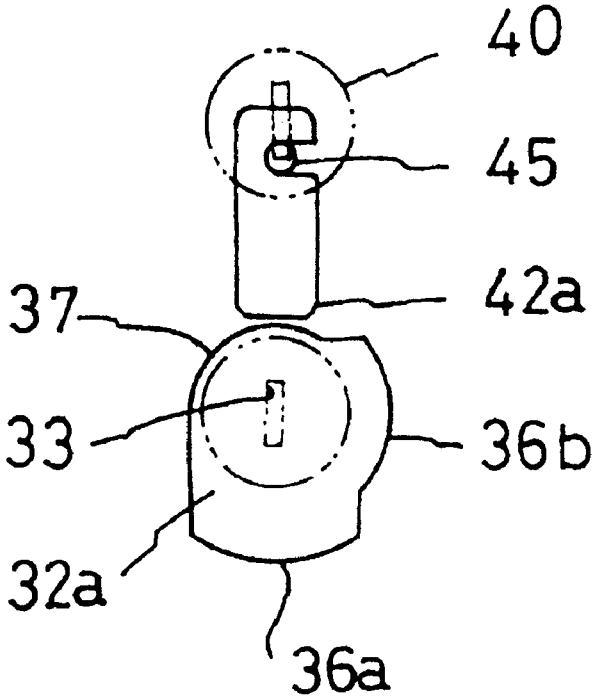
FIG. 8 is an enlarged front view of the movable locking elements of the second embodiment of the door locking handle assembly, illustrating the movable locking elements in a condition in which the door handle is capable of being locked using the first key only.

FIGS. 6 to 8 shows a second embodiment of the door locking handle assembly according to the third aspect of the present invention.

The second embodiment differs from the first embodiment in that the second embodiment employs a slight modification of the cam plate 32*a* serving as the first movable locking element 32 of the first lock 30 of the first embodiment. Such a slight modification of the cam plate 32*a* employed in the second embodiment will be hereinafter referred to as the modified cam plate 32*a*.

More specifically, as is clear from FIG. 6, the modified cam plate 32*a* is provided with a largest-diameter portion 36*a* and a larger-diameter portion 36*b*. These portions 36*a*, 36*b* are angularly spaced apart from each other by a predetermined angle, for example such as an angle of 90 degrees, an angle of 120 degrees, or the like. In operation, when each of these portions 36*a*, 36*b* is oppositely disposed from the free end portion 17 of the door handle 15, the first rotor 31 may assume each of two locked positions. More specifically, in the second embodiment, as is clear from FIGS. 6 and 7, the modified cam plate 32*a* of the first rotor 31 has two locked positions.

Now, the second embodiment of the present invention will be described in operation.

The second embodiment is quite similar in construction, action and effect to the first embodiment except the provision of the largest-diameter portion 36*a* in the modified cam plate 32*a* employed in the second embodiment, as is clear from FIGS. 6 to 8.

As shown in FIG. 6, when the largest-diameter portion 36*a* of the modified cam plate 32*a* is oppositely disposed from a lower end portion of the latch plate 42*a* in an overlapping manner in a condition in which the latch plate 42*a* is held in its highest position, it is not possible for the second key K2 to have the latch plate 42*a* disengaged from the largest-diameter portion 36*a* of the modified cam plate 32*a*. In contrast with this, it is possible for the first key K1 to have the largest-diameter portion 36*a* of the modified cam plate 32*a* selectively disengaged from or engaged again with the lower end portion of the latch plate 42*a*.

On the other hand, when the modified cam plate 32*a* has its larger-diameter portion 36*b* oppositely disposed from the lower end portion of the latch plate 42*a* in an overlapping manner in a condition in which the latch plate 42*a* is held in its lowest position shown in FIG. 7, it is possible for the second key K2 to have the lower end portion of the latch plate 42*a* selectively disengaged from or engaged again with the large-diameter portion 36*b* of the modified cam plate 32*a*. When the modified cam plate 32*a* holds the large-diameter portion 36*b* thereof in its highest position as shown in FIG. 7, it is also possible for the second key K2 to have the lower end portion of the latch plate 42*a* selectively disengaged from or engaged again with the large-diameter portion 36*b* of the modified cam plate 32*a*.

Further, as shown in FIG. 8, when the small-diameter portion 37 of the modified cam plate 32*a* is oppositely disposed from a lower end portion of the latch plate 42*a* held in its lowest position, it is not possible for the second key K2 to have the lower end portion of the latch plate 42*a* engaged with the small-diameter portion 37 of the modified cam plate 32*a*. However, in this condition, it is possible for the first key K1 to have a desired one of the large-diameter portion 36*b* and the largest-diameter portion 36*a* of the modified cam plate 32*a* selectively engaged with the lower end portion of the latch plate 42*a* in an overlapping manner.

As is clear from FIG. 1, in the first embodiment of the present invention, the handle holder 10 and the door handle 15 are provided with the first lock 30 with the first key K1 and the second lock 40 with the second key K2, respectively. The user (i.e., door keeper) may use any one of these keys K1, K2 to lock and unlock the door handle 15 with respect to the handle holder 10. Consequently, it is possible for each of two different users (or door keepers) to independently hold and maintain each of these keys K1, K2 on an equal footing with each other.

In the first embodiment according to the second aspect of the present invention, since the second movable locking element 42 is so arranged as to be engaged with the first movable locking element 32, it is possible to disengage these movable locking elements 32, 42 from each other by disengaging a desired one of these elements 32, 42 from the other, which results in unlocking operation of the door handle 15 from the handle holder 10.

In the second embodiment according to the third aspect of the present invention, since the second embodiment has the above construction and action, it is possible for the door keeper to determine which of these keys K1, K2 he or she uses as his or her primary control key.

Further, since the door locking handle assembly of the present invention is provided with two pieces of the locks 30 and 40 together with their keys K1 and K2, it is possible to strictly improve the assembly in locking mechanism and in appearance.

While the present invention has been particularly shown and described with reference to the preferred embodiments thereof, it will be understood by those skilled in the art that various modifications and changes may be made therein without departing from the spirit of the present invention as defined by the appended claims.

What is claimed is:

1. In a door locking handle assembly of a double lock type having a construction in which: a handle holder (10) is mounted on a front surface (B1) of a door (B) by means of a screw (11), said screw (11) passing through said door (B) from a rear surface (B2) to fix said handle holder (10) to said front surface (B1) of said door (B); a handle shaft (12) extending in a direction perpendicular to the plane of said door (B) is mounted on a proximal end portion of said handle holder (10); a door handle (15) has a proximal end portion mounted on a front end portion (13) of said handle shaft (12) through a pivot (14) extending in a direction perpendicular to a longitudinal axis of said handle shaft (12), said door handle (15) having a distal end portion swung between a folded position and a raised position thereof in a reciprocating manner; and, a catch plate for locking said door (B) to a stationary frame element is fixedly mounted on a rear end portion (16) of said handle shaft (12), said rear end portion (16) appearing in said rear surface (B2) of said door (B), the improvement wherein:

a first lock (30) and a second lock (40) have their rear end portions fixedly mounted on an inner surface of a free end portion (17) of said door handle (15) and an inner surface of said handle holder (10), respectively, in a manner such that said locks (30, 40) are adjacent to each other in arrangement; and said first lock (30) and said second lock (40) are provided with a first key (K1) and a second key (K2), to permit a user to lock and unlock said door handle (15) using at least one of said keys (K1, K2).

2. The door locking handle assembly of the double lock type as set forth in claim 1, wherein:

each of said first lock (30) and said second lock (40) is constructed of a cylinder lock;

said first key (K1) is inserted into said first lock (30) of said handle holder (10), and turned to rotate a first rotor (31) of said first lock (30), 50 that a first movable locking element (32) is moved to a locked position adjacent to said free end portion of said door handle (15), wherein said first movable locking element (32) is constructed of a latch plate or a cam plate; and said second key (K2) is inserted into said second lock (40) of said door handle (15), and turned to rotate a second rotor (41) of said second lock (40), so that a second movable locking element (42) is moved between: a locked position in which said second movable locking element (42) is engaged with said first movable locking element (32); and, an unlocked position in which said second movable locking element (42) is disengaged from said first movable locking element (32), wherein both said locked position and said unlocked position of said second movable locking element (42) are adjacent to said first movable locking element (32).

3. The door locking handle assembly of the double lock type as set forth in claim 1 or 2, wherein:

said first rotor (31) of said first lock (30) disposed in said handle holder (10) is locked in each of two locked positions and unlocked in its unlocked position, wherein said two locked positions are angularly spaced apart from each other by a predetermined angle, each of said two locked positions being also angularly spaced apart from said unlocked position by a predetermined angle;

said first movable locking element (32) is locked in each of two locked positions and unlocked in an unlocked position, wherein said two locked positions are angularly spaced apart from each other by a predetermined angle and adjacent to said free end portion (17) of said door handle (15), each of said two locked positions being also angularly spaced apart from said unlocked position by a predetermined angle, wherein a first one of said two locked positions is closer to said free end portion (17) of said door handle (15) than the other to disable said second movable locking element (42) from disengaging from said first movable locking element (32) even when said second movable locking element (42) is moved to said unlocked position thereof;

said first movable locking element (32) is moved to said the other of said two locked positions thereof to enable said second movable locking element (42) to engage with and disengage from said first movable locking element (32); and in said unlocked position of said first movable locking element (32), said second movable locking element (42) is always disengaged from said first movable locking element (32) irrespective of whether said second movable locking element (42) is in its locked position.

4. The door locking handle assembly of the double lock type according to claim 1, wherein each of said first lock (30) and said second lock (40) is a pin tumbler type.

5. The door locking handle assembly of the double lock type according to claim 1, wherein each of said first lock (30) and said second lock (40) is a disc tumbler type.

6. The door locking handle assembly of the double lock type according to claim 2, wherein said first movable locking element (32) is constructed of a cam plate having a rotary motion.

7. The door locking handle assembly of the double lock type according to claim 2, wherein said second movable locking element (42) is constructed of a latch plate having a reciprocating motion.

8. The door locking handle assembly of the double lock type according to claim 2, wherein said second rotor (41) is attached to said second movable locking element (42) by an eccentric pin (45) which extends rearward from a rear surface of the second rotor (41).

9. In a door locking handle assembly of a double lock type having a construction in which: a handle holder (10) is mounted on a front surface (B1) of a door (B) by means of a screw (11), said screw (11) passing through said door (B) from a rear surface (B2) to fix said handle holder (10) to said front surface (B1) of said door (B); a handle shaft (12) extending in a direction perpendicular to the plane of said door (B) is mounted on a proximal end portion of said handle holder (10); a door handle (15) has a proximal end portion mounted on a front end portion (13) of said handle shaft (12) through a pivot (14) extending in a direction perpendicular to a longitudinal axis of said handle shaft (12), said door handle (15) having a distal end portion swung between a folded position and a raised position thereof in a reciprocating manner; and, a catch plate for locking said door (B) to a stationary frame element is fixedly mounted on a rear end portion (16) of said handle shaft (12), said rear end portion (16) appearing in said rear surface (B2) of said door (B), the improvement wherein:

a first lock (30) and a second lock (40) have their rear end portions fixedly mounted on an inner surface of a free end portion (17) of said door handle (15) and an inner surface of said handle holder (10) respectively, in a manner such that said locks (30,40) are adjacent to each other in arrangement;

said first lock (30) and said second lock (40) are provided with a first key (K1) and a second (K2), respectively, to permit a user to lock and unlock said door handle (15) using at least one of said keys (K1, K2), each of said first lock (30) and said second lock (40) is constructed of a cylinder lock;

said first key (K1) is inserted into said first lock (30) of said handle holder (10), and turned to rotate a first rotor (31) of said first lock (30), so that a first movable locking element (32) is moved to a locked position adjacent to said free end portion (17) of said door handle (15), wherein said first movable locking element (32) is constructed of a cam plate; and said second key (K2) is inserted into said second lock (40) of said door handle (15), and turned to rotate a second rotor (41) of said second lock (40), so that a second movable locking element (42) is moved between: a locked position in which said second movable locking element (42) is engaged with said first movable locking element (32); and an unlocked position in which said second movable locking element (42) is disengaged from said first movable locking element (32); wherein both said locked position and said unlocked position of said second movable locking element (42) are adjacent to said first movable locking element (32); and, said second movable locking element (42) is constructed of a latch plate attached to said first rotor (31) by an eccentric pin (45).

* * * * *